United States Patent [19]

Hopkins et al.

[11] Patent Number: 4,842,524

[45] Date of Patent: Jun. 27, 1989

[54] TRAILER LIGHT CONNECTION SYSTEMS

[75] Inventors: Ross E. Hopkins; P. David Tan, both of Emporia, Kans.

[73] Assignee: Hopkins Manufacturing Corporation, Emporia, Kans.

[21] Appl. No.: 116,471

[22] Filed: Nov. 3, 1987

[51] Int. Cl.[4] ..... H01R 33/79

[52] U.S. Cl. ..... 439/35; 439/39; 439/651

[58] Field of Search ..... 439/35, 412, 422, 425, 439/651, 39; 280/422; 307/10 LS; 191/11

[56] References Cited

U.S. PATENT DOCUMENTS

| | | | |
|---|---|---|---|
| 2,159,064 | 5/1939 | Walter | 439/412 |
| 2,981,921 | 4/1961 | Safford | 439/412 |
| 3,217,286 | 11/1965 | Duffield | 439/412 |
| 3,602,872 | 8/1971 | Braunstein | 439/425 |
| 3,745,515 | 7/1973 | Michaels | 439/651 |
| 4,005,313 | 1/1977 | Tibbits | 280/422 X |
| 4,064,413 | 12/1977 | Andersen | 307/10 LS X |
| 4,620,109 | 10/1986 | Kummer | 280/422 X |

*Primary Examiner*—Eugene F. Desmond

*Attorney, Agent, or Firm*—Calfee, Halter & Griswold

[57] ABSTRACT

A trailer light connection system includes T-shape connectors principally for truck lighting systems respectively having three terminals including a modularized tap plug, split wire connectors principally for automobile lighting systems respectively including a modularized plug and trailer wiring harnesses respectively used with either the T-shape connector or the split wire connector and having a modularized plug interconnecting therewith. By standardizing the system components and modularizing the plug connections, the trailer lighting system of the present invention reduces the number of stock keeping units required while simplifying system installation.

17 Claims, 4 Drawing Sheets

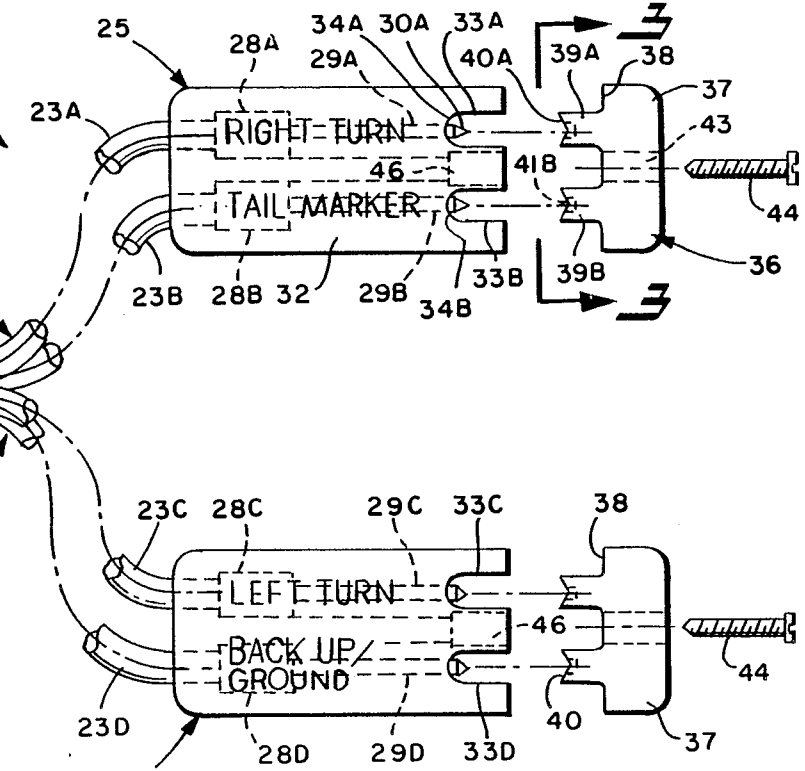
FIG. 2
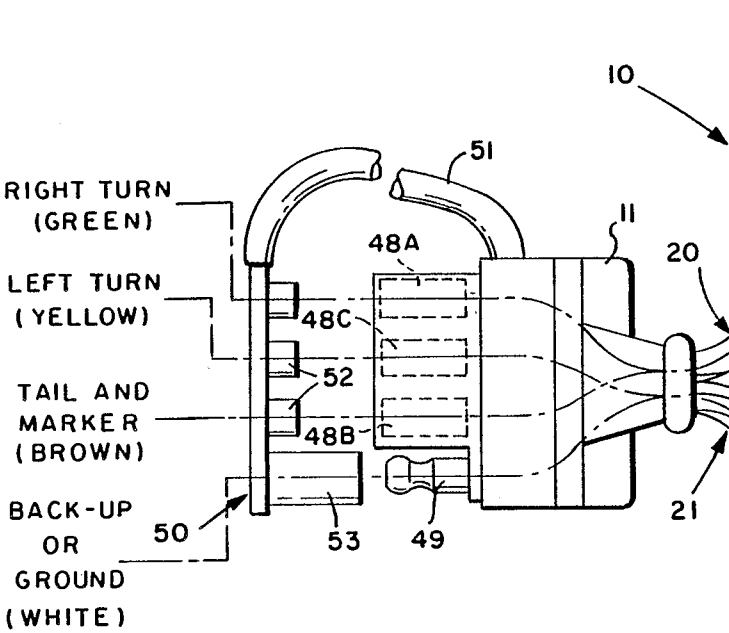
FIG. 3
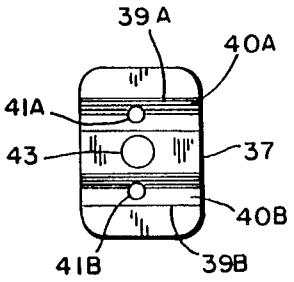

TRAILER LIGHT CONNECTION SYSTEMS

FIELD OF THE INVENTION

The present invention relates to a trailer light connection system in general and to connector components thereof providing easy and reliable installation in specific.

BACKGROUND OF THE INVENTION

Trailer light connector systems are well known in the art. The systems differ slightly depending upon the type of towing vehicle.

In a pickup truck for example, the factory installs as original equipment electrical wiring for the cab and electrical wiring for the chassis. The cab wiring and chassis wiring are electrically interconnected by a plug having male terminals and a plug having female terminals cooperatively coupled as a plug set to complete the electric circuit therebetween.

A T-shape connector may selectively be interposed between the plugs of the plug set to retain the overall vehicle circuit while providing a tap for electrical power to a trailer. T-shape connectors of this type have been commercially available from the assignee of the present invention and from its predecessor in interest, Olathe Automotive Wiring Company. This prior art T-shape connector included a plurality of individual insulated wires extending outwardly from the T-shape connector body for the trailer tap. These insulated tap wires from the T-shape connector body were then hard wired to the vehicle end of a trailer wire harness extending rearwardly to the trailer. This hard wiring of the trailer tap to the trailer wire harness was inconvenient and time consuming and required care and experience in matching the tap wires of the T-shape connector to like wires in the trailer wiring harness. In addition, at times, special tools, such as a soldering gun, were required to complete the hard wiring process.

When the towing vehicle is a car, the insulated electrical wires leading to the left and right bank of car tail lights respectively run along the left and right hand side of the trunk space. The prior art connection systems include individual wires from the trailer harness or a trailer harness extension. These individual wires have clips on the ends thereof, with these clips being individually clipped onto the vehicle wires in the trunk. The clips include barbs to penetrate the wire insulation and contact the conductor. These individual clip connections were inconvenient and time consuming to install and did not always provide a reliable electrical connection.

SUMMARY OF THE INVENTION

The principal object of the present invention is to provide trailer light connection systems that may be quickly and reliabily installed without special tools.

It is another object of the present invention to provide a T-shape connector in a trailer light connection set for pickup trucks or the like having a plug-in trailer tap connection. This trailer tap plug is of the same size and configuration for all sizes and configurations of T-shape connectors utilized in different vehicles from different manufactures. By providing tap plug uniformity for the trailer, the number of stock keeping units of wire harnesses may be reduced while allowing rapid assembly with proper electrical installation.

It is yet another object of the present invention to provide a split wire extension for the trailer wire harness having connectors at the ends thereof. The connectors have integrally formed slots with associated light function indicia for the respective car wires to permit insulation displaced connections reliably to be made with each vehicle wire in the trunk. An end cap is screwed onto the connector body with drive shoulders on the end cap being advanced into the slots to complete the insulation displaced connection.

These and other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE DRAWINGS

FIG. 2 is a partially fragmented elevation of the split wire connector extension for the trailer wire harness of FIG. 1;

FIG. 3 is an end view of the end cap taken along the plane 3—3 of FIG. 2, the end cap being screwed onto the connector body to complete the insulation displaced connections;

DETAILED DESCRIPTION OF THE PREFERRED EMBODIMENTS

Figures 1, 1A, 1B:
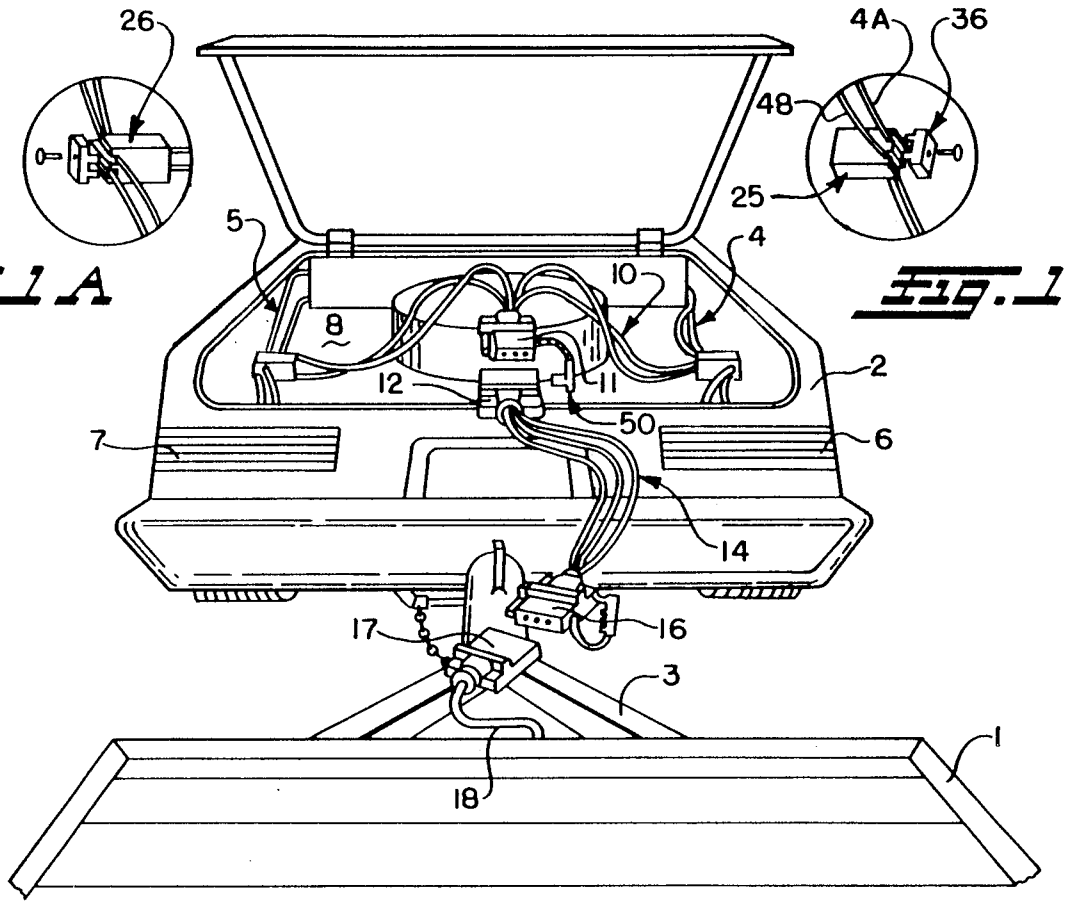
FIG. 1 is a perspective view of the trailer light connection system of the present invention for cars, with the vehicle wire connectors blown up in insets for clarity of illustration.

Turning now in more detail to the drawings and initially to FIG. 1, a trailer 1 is mechanically removably connected to car 2 by means of trailer yoke 3. The electrical lighting system of the car may be readily coupled to the electrical lighting system of the trailer by the trailer light connection system of the present invention.

To this end, the insulated car wires indicated generally at 4 and 5 for the right and left tail lights 6 and 7 respectively run along the right and left hand sides of trunk 8. The respective electrical connections are made to these vehicle wires by a split wire connector extension indicated generally at 10. The extension 10 includes a plug 11 selectively connected to a complementary mating plug 12 at one end of trailer wiring harness indicated generally at 14. The other or rear end of the trailer wiring harness 14 has a plug 16 selectively coupled to a mating plug 17 on the trailer lighting system 18. When the split wire extension 10, wiring harness 14 and trailer lighting system 18 are plugged together, the electrical circuit between the car and trailer is complete.

Turning now to FIG. 2, the split wire connector extension indicated generally at 10 for a four wire car lighting system includes two separate or split pairs 20 and 21 of insulated wires. In the first pair 20, insulated wire 23A is color coded green and is operatively adapted for the right turn signal function. The second insulated wire 23B of the first pair is color coded brown and is operatively adapted for the tail marker function. In the second split pair 21, insulated wire 23C is color coded yellow and is operatively adapted for the left turn signal function. The second insulated wire 23D in the second split pair 21 is color coded white and is operatively adapted for the backup light or ground electrical function. The first pair of wires 23A and 23B have their respective forward ends embedded in and mounted to a first connector, indicated generally at 25, while the second pair of insulated wires 23C and 23D have their respective forward ends embedded in and mounted to a separate second connector, indicated generally at 26.

The termination assembly on the forward end of each wire 23A–23D is essentially identical. For ease of description, the termination assembly for wire 23A will be described, with letter suffixes being used to identify like parts for the other wire termination assemblies.

In assembling the termination, the insulation surrounding the conductor 23A at the leading or forward end of the wire is peeled back to expose the conductor. A split ring metal sleeve 28A is positioned partially to receive the end of the exposed conductor in its bore. A conductive roll pin 29A has its flat end inserted into the opposite end of the bore of split ring sleeve 28A. Preferably, the exposed conductor end and flat pin end are brought into abutment with one another, with the bore of the split ring splice sleeve being slightly larger in diameter than the exposed conductor and pin. The split ring sleeve 28A is then radially contracted by crimping to splice the wire 23A, sleeve 28A and pin 29A into an end-to-end mechanical and electrical connection. The leading end of pin 29A has a sharpened conical point 30A. After each wire has its end termination assembled, the connector can be molded around the wire terminations.

For example, to make the assembled connector 25, the wires 23A and 23B with their respective assembled sleeves and pins are held in a fixture in parallel relationship to one another within a mold (not shown). A plastic material, preferably black ABS platic, is then molded around the wire ends, sleeves and pins to form connector body 32. Body 32 as molded has two spaced slots 33A and 33B in its leading end, which slots extend the full width of the body 32.

Slot 33A is in axial longitudnal alignment with pin 29A, while slot 33B is in axial longitudnal alignment with pin 29B. Each of the slots 33A and 33B has an arcuate blind end 34A and 34B, respectively, which is of sufficient depth within body 32 to expose the pointed ends 30A and 30B of pins 29A and B in axial alignment therewith. In other words, the pointed end of each pin would extend into the base of its respective slot and be exposed therein prior to completing the connection to the car wires.

The automobile wire connection process is enhanced by providing indicia on the connector body. The indicia respectively identify by their placement the respective electrical functions of the associated wires in the split wire extension. As shown, the indicia "right turn" and "tail marker" are formed on or applied to connector 25 by being spacially superimposed over wires 23A and 23B respectively. The indicia "left turn" and "backup/-ground" are formed on or applied to connector 26 by respectively being spacially superimposed over wires 23C and 23D performing these functions.

For connecting the split wire extension 10 to the car wires, a standard voltage tester may be used to identify the electrical function of the car wires in the trunk. This voltage tester may be provided as part of a trailer light connection kit. As is well known in the art, to identify the respective trunk wires, the car light function is manually initiated, such as turning on the right turn signal, and the car wires on the right side of the trunk are then tested by the voltage tester to determine which one of the wires has a voltage applied thereto for performing the right turn function. When thus identified, the insulated right turn wire 4A is slipped into the appropriate indicated slot 33A in connector body 32. The tail marker wire 4B is identified in the same manner and then partially inserted into slot 33B. An insulation displaced electrical connection with the two wires 4A and 4B can then be completed by assembling an end cap, indicated generally at 36, onto body 32.

The end cap 36 includes a base flange 37 having a bottom wall 38. Two laterally spaced drive shoulders 39A and 39B project inwardly from bottom wall 38. The spacing between drive shoulder 39A and 39B corresponds to the spacing between the slots 33A and 33B, with the width of the respective drive shoulders being slightly less than the width of the slots. The leading ends of the drive shoulders 39A and 39B are respectively provided with V-shape grooves 40A and 40B to cooperate with the outer diameter of the insulated car wires. The base of each groove 40A and 40B has a circular socket 41A and 41B formed therein. The sockets 41A and 41B are respectively adapted potentially to receive the pointed ends 30A and 30B of the pins in alignment therewith when the drive shoulders 39A and 39B have been fully advanced into their respective connector body slots 33A and 33B.

To this end, a hole 43 extends through body flange 37 of end cap 36. The hole 43 is parallel to the axes of the drive shoulders and is positioned therebetween at the center of body flange 37, as best shown in FIG. 3. The shank of tapping screw 44 is passed through hole 37 and into blind end connector bore 46 axially aligned therewith. Bore 46 is molded into the center of the forward end of body 32 in the land between slots 33A and 33B. By using a screwdriver, the shank of tapping screw 38 upon rotation advances into bore 46 simultaneously to advance drive shoulders 39A and 39B into their respective slots 33A and B. The complemental rectangular configurations of the drive shoulders and slots precludes the end cap from rotating while the screw is being rotated. The screw 44 is rotated until the bottom wall 38 of base flange 37 abuts the front end of connector body 32. When this condition is achieved, the pointed ends 30A and 30B of the respective pins 29A and 29B have been forced through the insulation of the respective vehicle wires 4A and 4B received in the slots to displace the insulation and contact the conductor, thereby to form a reliable electric connection therebetween. The assembled end cap with its abutting base flange and drive shoulders received in the slots physically encloses the wire connections to act as a moisture and contaminant barrier for protecting the integrity of the electrical connection.

The pointed ends 30A and 30B of pins 29A and B may respectively be received in the sockets 41A and 41B in the grooves of the drive shoulders 39A and 39B. The length of each of the drive shoulders 39A and 39B is coordinated with the length of the exposed pointed ends of the pins and the diameter of the vehicle wires to insure that the pointed ends of the pins will displace the insulation and contact the conductors for electrical connection when the end cap is screwed into abutment, thereby to complete the wedging clamp between the pointed pins and shoulders and the wire positioned therebetween. The sockets 41A and 41B in being adapted to receive the pointed ends of the pins provide some spacial play or relief to compensate for any differences between the pins in their respective lengths or their relative placement in the connector body.

When the connections have been completed for connector 25, the same general process is repeated for connector 26. The left turn wire 5C and back up or ground wire 5D in the vehicle are identified by using the voltage tester. Wires 5C and 5D are then respectively placed in slots 33C and 33D which have indicia associated therewith to identify their left turn and back up or ground electrical functions as shown in FIG. 2. A second end cap 36 is then screwed onto connector 26 to complete the displaced insulation connection with car wires 5C and 5D in the manner described above.

The other ends of wires 23A and 23B from connector 25 and wires 23C and 23D from connector 26 commonly terminate in plug 11. Plug 11 has three female terminals 48A, B and C and one male terminal 49. For shipment or storage, these terminals are protected from dust or other contaminants by a dust cover, indicated generally at 50. The dust cover may be loosely connected to plug 11 by retention flap 51 to avoid losing the dust cover when not in use. The dust cover 50 has three male studs 52 and a female socket 53 projecting from one side thereof. When the dust cover is in use with plug 11, the male studs 52 are respectively received in female terminals 48A–48C, and the female socket 53 receives the male terminal 49. When the dust cover 50 is withdrawn and pivoted out of the way to an inoperative position, plug 11 may be connected to plug 12 of the trailer wiring harness 14 as described above to complete the electrical circuit to the trailer.

Figure 4:
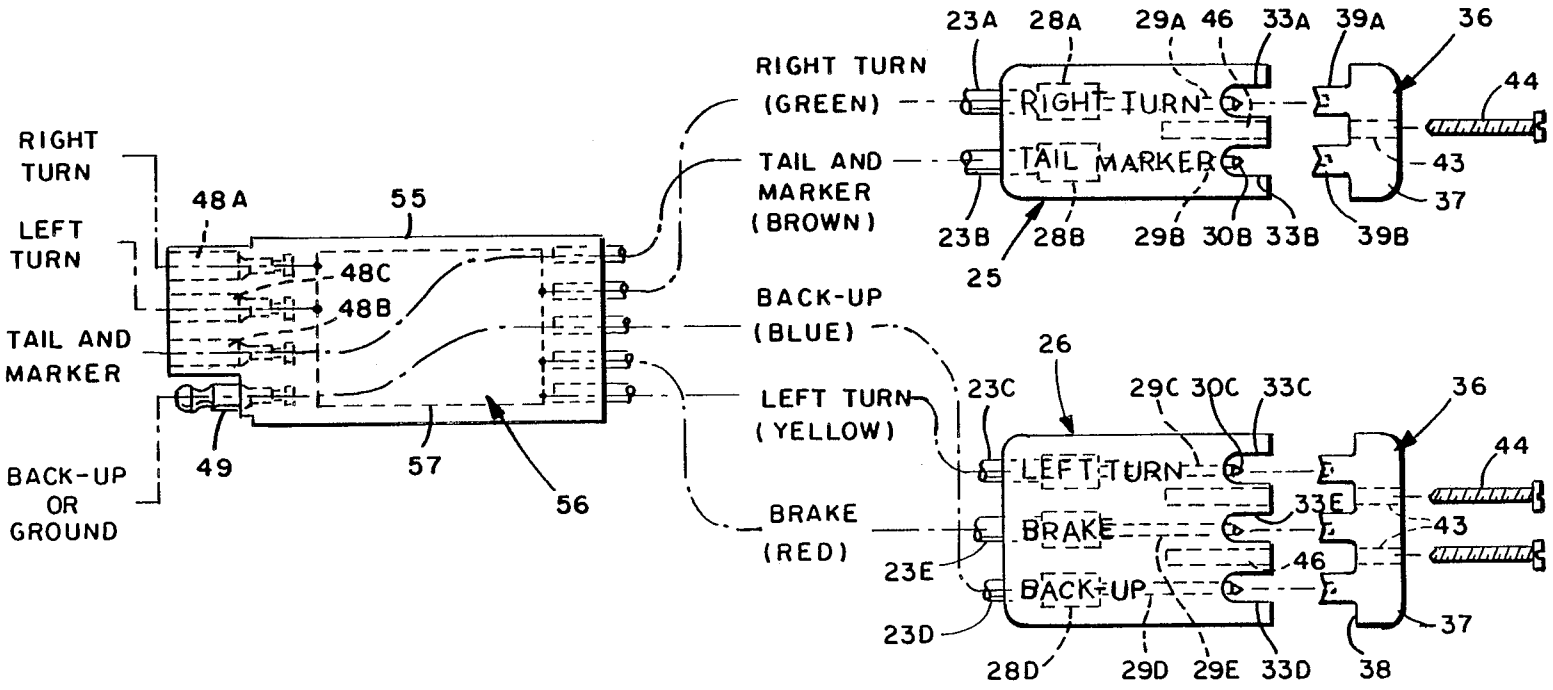
FIG. 4 is a partially fragmented elevation similar to FIG. 2 showing a split wire connector extension with a five wire to four wire converter.

Turning now to FIG. 4, a split wire connector extension have five wires is shown that is similar to the four wire extension of FIGS. 1–3, with identical parts being identified by identical reference numerals. Cars having amber turn signals rather than red have five wires rather than four, thereby requiring the five wire split connector of FIG. 4. To accomodate the difference in the number of car wires, the second connector 26 has three slots 33C, 33D and 33E in its body with the pointed ends of pins 29C, 29D and 29E respectively extending into the blind ends of these slots. These pins are respectively connected by crimped metal sleeves to insulated wires 23C, 23D and 23E. The respective electrical functions of pins 29C–29E and their associated wires 23C–23E are indicated on the connector body by the left turn, back up and brake indicia associated therewith as illustrated in FIG. 4. The five car wires are identified and assembled into their respective insulation displaced electrical connections in the two split connectors 25 and 26 in the manner described above.

The two wires 23A and 23B from connector 25 and the three wires 23C–23E from connector 26 commonly terminate at their other ends in a plug 55 having a converter generally indicated generally at 56. As schematically illustrated in FIG. 4, the converter includes wire 23B extending to female terminal 48B and wire 23D extending to male terminal 49. Also in converter 56, wires 23A, 23C and 23E are coupled to output terminals 48A and 48C by a conventional printed circuit board 57 operative to convert a three wire input to a two wire output.

The printed circuit board converter and terminals are integrally formed into plug 55. Plug 55 may selectively be coupled to plug 12 of wiring harness 14 to complete the electrical circuit to the trailer.

Figure 5:
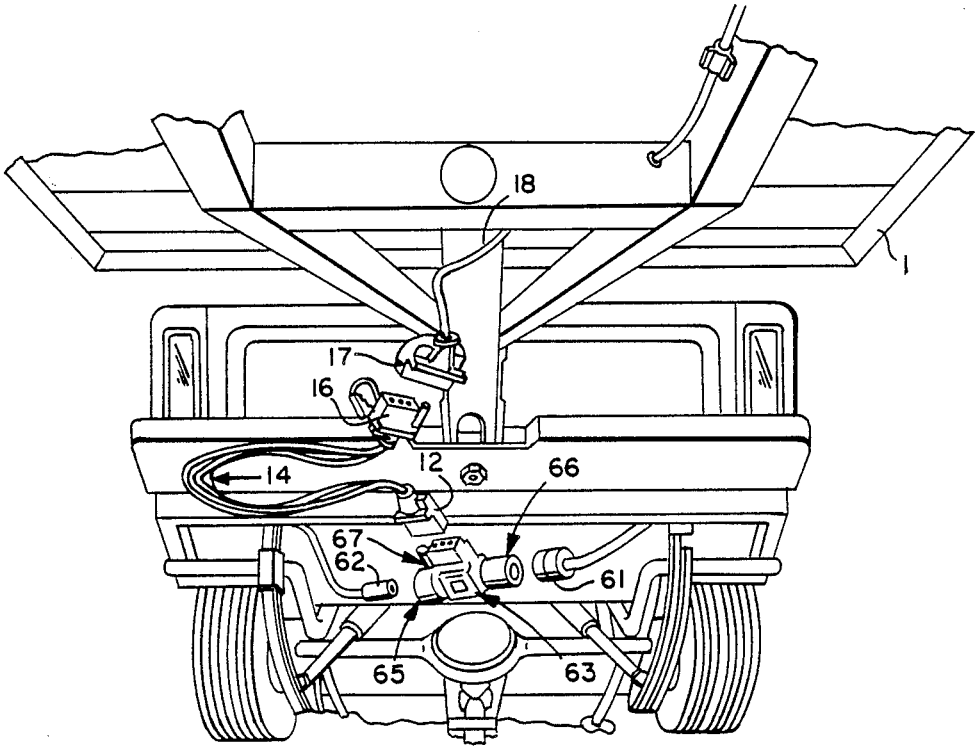
FIG. 5 is a bottom perspective of the trailer light connection system including a modular T-shape connector of the present invention for use with a pickup truck.
Figure 6:
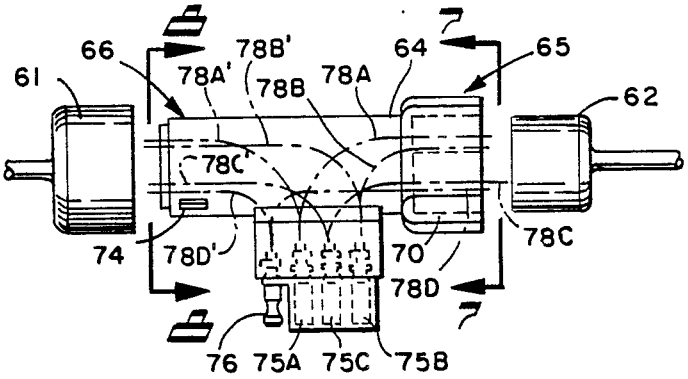
FIG. 6 is an elevation of the modular T-shape connector of FIG. 5, with the wiring and electrical connections in the connector body being schematically illustrated.

Turning now to FIGS. 5 and 6, the trailer light connection system of the present invention may include a T-shape modular connector for use with pickup trucks or the like. In such an application, the pickup truck, indicated generally at 60, includes as original equipment two separate electrical systems which are normally plugged together. The cab of the pickup truck 60 will include an electrical system terminating in a plug 61. The truck body or chassis will have an electrical system terminating in a plug 62. Plugs 61 and 62 are normally joined together by cooperating male and female terminals to couple the two electrical systems together into one overall electrical circuit for the vehicle. The specific form and size of the plugs 61 and 62 and of their respective male and female terminals may vary from model to model and/or from year to year.

Figure 8:
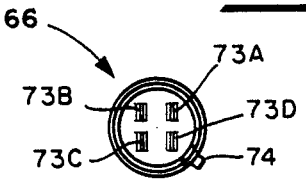
FIG. 8 is an end view of a second terminal means on the T-shape connector of FIG. 6 taken along the plane 8—8 in FIG. 6.
Figure 7:
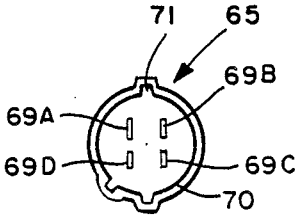
FIG. 7 is an end view of one terminal means on the T-shape connector of FIG. 6 taken along the plane 7—7 in FIG. 6.

To provide a trailer tap into the electrical circuit of pickup truck 60, a T-shape connector, indicated generally 63, is inserted between plugs 61 and 62. In FIGS. 6–8, a T-shape connector for use with a Ford pickup truck for model years 1980 to date is shown as illustrative of the concepts of the present invention. The T-shape connector 63 has a molded plastic body 64, preferrably made of black PVC. The T-shape molded body 64 has a first male terminal means, indicated generally at 65, a second female terminal means, indicated generally at 66, and a third trailer tap terminal means, indicated generally at 67.

The first male terminal means 65 includes four spaced male terminal blades or prongs 69A–69D. These blades 69A–D are mounted in and extend outwardly from the T-shape body 64. The blades 69 are surrounded by a shroud or skirt 70 integrally formed with the molded body 64. The skirt 70 preferrably has three circumferentially spaced outwardly extending key-ways 71 formed therein. These key-ways cooperate with outwardly projecting ribs on plug 62 properly to orient and guide the plug 62 relative to first terminal means 65. The plug 62 has four female terminal receptacles which receive the male blades 69 when the plug 62 is fully received in shroud 70.

Second terminal means 66 includes four spaced female terminal receptacles 73A–73D. These female receptacles receive the male terminal blades on the plug 61. Plug 61 has a configuration corresponding to the first terminal means 65 and has a skirt thereon which surrounds second terminal means 66 when the plug 61 is fully made up. The plug 61 is properly oriented and guided by a rib 74 on body 64 cooperating with a keyway 75 in the inner wall of the protective skirt on plug 61.

The third terminal means 67, which provides the electrical tap for the trailer, includes three female receptacle terminals 75A through 75C and a male terminal 76. As shown, electrical wires are embedded in the T-shape connector body 64 electrically interconnecting the three terminal means.

To this end, electrical wire 78A extends from male blade 69A to female receptacle terminal 75A, and wire 78A' extends from female receptacle terminal 75A to female receptacle 73A. Wires 78A and 78A' have a common conductive contact at female receptacle 75A to form a closed or continuous circuit between the male terminal blade 69A of the first terminal means, the female receptacle contact 75A of the third terminal means and the female receptacle 73A of the second terminal means.

The other functionally corresponding terminal blades and female terminal receptacles in the three terminal means are similarly wired as illustrated. Specifically, wire 78B interconnects male terminal 69B of the first terminal means with female receptacle 75B of the third terminal means, and wire 78' interconnects receptacle 75B of the third terminal means with female terminal receptacle 73B of the second terminal means. Wire 78C interconnects male terminal 69C with female terminal 75C and wire 78C' interconnects female terminal 75C with female terminal 73C. Finally, wire 78D interconnects male terminal 69D to male terminal 76 and wire 78D' interconnects male terminal 76 to female terminal 73D.

As will be apparent from the above, when female plug 62 is connected to the first terminal means 65 and the male plug 61 is connected to the second terminal means 66, the interposed T-shape connector 63 has maintained electrical circuit continuity for the overall vehicle between the chasis electrical system and the cab electrical system, while providing an activated third terminal means as a tap for electrical power to the trailer lighting system. The cooperating ribs and keyways on the plugs and T-shape connector insure that terminals of like function are coupled to maintain the lighting integrity of the system.

The third terminal means 67 in the form of a plug with three female terminals and one male terminal may readily be plugged into the cooperating plug 12 on the lead end of the trailer wiring harness 14. Plug 12 has three male terminals and a female receptacle terminal cooperatively interfitting in the proper electrical and mechanical orientation with the terminals on the third terminal means 67 of the T-shape connector 63. Thus, the trailer wiring harness can be easily and rapidly plugged into the T-shape connector to provide a reliable electrical connection for the trailer. The other or rear end of trailer wiring harness 14 has a plug 16 that cooperatively mates with a plug 17 on the trailer wiring system to complete the lighting circuit between the pick-up truck 60 and the trailer 1.

The third terminal means is of identical size and configuration for each T-shape connector 63. Thus, even though the T-shape connector may otherwise vary in size and/or terminal configuration for the first and second terminal means depending upon the vehicle manufacturer and model year, the third terminal means or trailer tap is identical for each and every T-shape connector. By standardizing the third terminal means and all T-shape connectors, a modular trailer light connection system is provided for pick-ups or other trucks. The standardized third terminal means allow the number of stock keeping units required for trailer wiring harnesses to be reduced while providing an easy to use system.

It will be apparent from the foregoing that changes may be made in the details of construction and configuration without department from the spirit of the invention as defined in the following claims.

We claim:

1. A trailer light connector system extending between a towing vehicle and a towed vehicle to provide electrical power from a vehicle light circuit to the trailer light circuit, the system comprising a trailer wiring harness selectively extending between a split wire extension and the trailer light circuit, the trailer wiring harness having means at one end thereof adapted selectively to be coupled to the trailer light circuit and having a first plug means at the other end thereof adapted selectively to be coupled to a second plug on the the split wire extension, the split wire extension having electrical wires respectively extending to two separate connector means at the ends thereof, each such connector means having means adapted selectively to make an insulation displaced electrical connection with each insulated wire of the towing vehicle light circuit to complete the electrical connection between the towing vehicle and trailer.

2. The trailer light connector system of claim 1 wherein each connector means includes an insulative connector body molded onto and around terminal ends of at least two of the respective, spaced wires of the split wire extension.

3. The trailer light connector system of claim 2 wherein the terminal ends each include a metal sleeve crimped onto the wire conductor and a pin inserted therein to form a splice connection therebetween, with the wire ends, metal sleeves and most of the pins being embedded in and enclosed by the connector body molded therearound.

4. The trailer light connector system of claim 3 wherein the insulation displaced connection means includes at least two blind end slots in one side of the connector body, with pointed ends on the pins respectively extending into the blind ends of said slots.

5. The trailer light connector system of claim 4 wherein the insulation displaced connection means includes an end cap for each connector body, the end cap including a base flange and at least two drive shoulders projecting from the base flange.

6. The trailer light connector system of claim 5 wherein the drive shoulders are respectively aligned with and received in the connector slots when the end cap is connected to said one side of the connector body.

7. The trailer light connector system of claim 5 wherein the insulation displaced connection means includes indicia means on the connector body adjacent the slots indicating their respective light functions, the vehicle wires operatively corresponding to the indicated light functions being respectively partially received in the closed ends of the slots.

8. The trailer light connector system of claim 7 wherein a screw extends through a hole in the end cap base flange and into a hole in said one side of the connector body, with screw rotation drawing the base flange toward the connector body while advancing the drive shoulders into their respective slots.

9. The trailer light connector system of claim 8 wherein the drive shoulders and slots have complemental wall configurations precluding end cap rotation during screw rotation while enhancing wire enclosure, the length of the drive shoulders being coordinated with the depth of the slots and diameter of the vehicle wires whereby advancement of the drive shoulders urges the insulated wires against the pointed ends of the pins to drive the pointed ends of the pins through the insulation into electrical contact with the conductors in the vehicle wires.

10. The trailer light connector system of claim 9 wherein the leading ends of the drive shoulders respectively have grooves contoured to engage the outer diameter of the insulated vehicle wires, with the base flange of the end cap tightly abutting the one side of the connector body when the connection is made to provide a tight environmental enclosure of the insulation displaced electrical connections.

11. The trailer light connector system of claim 10 wherein the grooves in the leading ends of the respective drive shoulders have sockets positioned centrally thereof, the sockets providing spacial relief for the insulation displaced connection should the pins be of unequal length.

12. The trailer light connector system of claim 10 wherein the split wire extension wire ends, metal splicing sleeves, pins and closed end slots all extend axially, longitudinally of the connector body.

13. The trailer light connector system of claim 1 or claim 12 wherein one connector has three slots and the other connector has two slots, and the extension has a third plug means at the other end thereof with a five wire to four wire converter integrally formed therewith to allow the third plug means to be coupled to the second plug means of the wiring harness.

14. A trailer light connector system selectively to provide electrical power from a vehicle to a towed trailer comprising a T-shape connector having a body with three terminal means, the first terminal means being adapted for connection to a vehicle wiring plug, the second terminal means being adapted for connection to a second vehicle wiring plug to complete the vehicle electrical circuit, and the third terminal means constituting a tap plug adapted to provide a source of electrical power from the vehicle for the trailer, a wiring harness having a first harness plug removably coupled to the tap plug on the T-shape connector and means at the other end thereof to be coupled to a trailer light system to complete the electrical connection between the vehicle and trailer.

15. The trailer light connector system of claim 14 wherein the T-shape connector and the first and second terminal means may vary in size and configurations according to the vehicle wiring system, with the third terminal means having the same size and configuration for all T-shape connectors, thereby to provide modularity between different sizes of T-shape connectors and the first harness plug on the trailer wiring harness.

16. The trailer light connector system of claim 15 wherein the third terminal means forming the tap plug has three female terminal receptacles and a male terminal pin selectively cooperating in interfitting connections with three terminal pins and a terminal receptacle on the first harness plug of the trailer wiring harness, the cooperating configurations of the third terminal means and first harness plug insuring proper orientation and connection of the respective wires of like lighting function in the vehicle and wiring harness.

17. A trailer light connection system comprising:

T-shape connectors respectively having a body including first and second terminals adapted for respective connections to a vehicle wiring system and a third terminal having first modular plug means;

split wire extensions respectively including two connectors adapted for connection to a vehicle wiring system and electrical wires leading from the respective connectors to a common second modular plug means having coupling structure the same as the first modular plug means and trailer wiring harnesses including electrical wires having at one end a third modular plug means adapted to be coupled to either the first or second modular plug means and having at the other end means for connection to a trailer wiring system.

* * * * *

UNITED STATES PATENT AND TRADEMARK OFFICE

CERTIFICATE OF CORRECTION

PATENT NO. : 4,842,524

DATED : June 27, 1989

INVENTOR(S) : Ross E. Hopkins, et al.

It is certified that error appears in the above-identified patent and that said Letters Patent is hereby corrected as shown below:

Col. 8, line 21 please delete "the" before "split"

Col. 10, line 10 please delete "may" before "vary"

Signed and Sealed this

Seventeenth Day of August, 1993

Bruce Lehman

*Attest:*

BRUCE LEHMAN

*Attesting Officer*

*Commissioner of Patents and Trademarks*